US006761277B2

(12) United States Patent
Dotan

(10) Patent No.: US 6,761,277 B2
(45) Date of Patent: Jul. 13, 2004

(54) SQUARE KNOCK-DOWN BIN

(75) Inventor: Moshe Dotan, Hanegev (IL)

(73) Assignee: Dolav Dvir Lahav Plastics Products, Dvir (IL)

( * ) Notice: Subject to any disclaimer, the term of this patent is extended or adjusted under 35 U.S.C. 154(b) by 71 days.

(21) Appl. No.: 10/086,435

(22) Filed: Mar. 4, 2002

(65) Prior Publication Data

US 2002/0084274 A1 Jul. 4, 2002

Related U.S. Application Data

(63) Continuation-in-part of application No. 09/494,042, filed as application No. PCT/US01/00194 on Jan. 4, 2001, now Pat. No. 6,142,329.

(51) Int. Cl.[7] ..... B65D 19/18
(52) U.S. Cl. ..... 220/4.28; 220/7; 206/499
(58) Field of Search ..... 220/4.16, 4.26, 220/4.28, 4.29, 4.31, 4.32, 7; 206/504, 503, 499

(56) References Cited

U.S. PATENT DOCUMENTS

| | | | | |
|---|---|---|---|---|
| 1,482,926 | A | | 2/1924 | Hillyard |
| 1,828,088 | A | | 10/1931 | Robinson |
| 2,119,799 | A | | 6/1938 | Sivey |
| 2,942,749 | A | | 6/1960 | Rosenberg |
| 3,184,095 | A | | 5/1965 | Brandon et al. |
| 3,374,915 | A | | 3/1968 | Verhein et al. |
| 3,401,814 | A | | 9/1968 | Chiswell et al. |
| 4,061,084 | A | * | 12/1977 | Bakkeren ..... 100/1 |
| 4,128,354 | A | | 12/1978 | Amrogowicx |
| 4,184,602 | A | * | 1/1980 | Moliard ..... 220/4.26 |
| 4,334,359 | A | * | 6/1982 | Kump ..... 312/111 |
| 4,809,851 | A | | 3/1989 | Oestreich et al. |
| 4,955,499 | A | * | 9/1990 | Petty ..... 220/4.28 |
| 5,056,677 | A | * | 10/1991 | Toyosawa ..... 220/4.21 |
| 5,094,356 | A | | 3/1992 | Miller |
| 5,193,714 | A | | 3/1993 | Carey |
| 5,236,099 | A | | 8/1993 | Fties et al. |
| 5,474,195 | A | * | 12/1995 | Pai ..... 220/4.26 |
| 5,505,323 | A | | 4/1996 | Naoki et al. |
| 5,529,199 | A | | 6/1996 | Foster |
| 5,638,973 | A | | 6/1997 | Dewey et al. |
| 5,642,830 | A | | 7/1997 | Foster |
| 5,967,356 | A | | 10/1999 | Laarhoven et al. |
| 6,189,695 | B1 | | 2/2001 | Ching-Rong |
| 6,311,858 | B1 | * | 11/2001 | Csiszar ..... 220/4.03 |

* cited by examiner

*Primary Examiner*—Joseph Man Fu Moy
(74) *Attorney, Agent, or Firm*—Mark M. Friedman

(57) ABSTRACT

Disclosed is a square knock-down bin with "L" shaped side elements so as to deploy on the base along portions to two adjacent base sides. Each of the side elements includes locking elements along each of its two ends. The locking-element at one of the ends is configured to interlock with the locking element of the adjacent side element to which it abuts. At least one of the side elements includes a displaceable locking-element along one of its two ends. The shape of the side elements is such that disassembled side elements from several bins will nest inside an assembled bin for storage and return shipping.

7 Claims, 13 Drawing Sheets

SQUARE KNOCK-DOWN BIN

This application is a Continuation-In-Part of PCT Application No. US01/00194, filed Jan 4, 2001, which is itself a Continuation-In-Part of U.S. application Ser. No. 09/494,042, filed Jan. 31, 2000, which is now Issued U.S. Pat. No. 6,142,329.

FIELD AND BACKGROUND OF THE INVENTION

The present invention relates to containers and, in particular, it concerns a square knock-down bin with "L" shaped side elements.

It is known to provide containers of many types for transporting produce, manufactured articles, raw materials etc. from one location to another. Such containers are generally configured to be lifted by a fork-lift vehicle and are stackable. These containers, typically referred to as "bins", "box-pallets", "crates" or"totes", will be referred to generically herein as"bins".

In many cases, molded polymer containers are chosen for their light weight, robustness and long usable lifetime. To realize the maximum strength of the polymer materials, polymer bins are often molded in a single piece. As a result, however, they occupy the same volume when transported empty on a return journey as when full on an outbound journey. This extremely inefficient use of space is very costly.

Various disassembling or foldable bins have been developed in an attempt to reduce the transport volume requirements when the bins are empty. All such bins that either disassemble (i.e., come apart into separate elements) or fold (i.e., with all elements remaining interconnected) are referred to generically herein as "knock-down bins".

The prior art suffered from a number of problems that were overcome by the knock-down bin of the parent application, U.S. Pat. No. 6,142,32. The sides of the rectangular bin of the parent application, when collapsed, fit within another such assembled bin, thereby facilitating convenient and compact return transport of the bins when not in use.

In some countries, however, the standards for such shipping bins and pallets include square bins, which are extensively used. While the parent application mentions a square configuration, it has been found that some changes were necessary to make a square configuration more practical.

There is therefore a need for a square knock-down bin formed from molded polymer materials, the sides of which having dimensions such that, when collapsed, the side elements would fit within another such assembled bin, thereby facilitating convenient and compact return transport of the bins when not in use. It would also be highly advantageous to provide a strong and durable locking configuration without increasing the number of separate elements which must be handled when the bin is disassembled.

SUMMARY OF THE INVENTION

The present invention is a square knock-down bin with "L" shaped side elements.

According to the teachings of the present invention there is provided, a square knock-down shipping bin comprising: a substantially square base having four substantially equal length base sides; four side elements having a first side portion and a second side portion that are perpendicular to each other meeting at a corner of the bin so as to define portions of two adjacent sides of the bin, the side elements being deployed so that the second side portion of one of the side elements is deployed along the same base side as, and substantially meets, the first side portion of an adjacent one of the side elements, thereby defining four vertical attachment portions configured for engagable locking of the first side portion and the second side portion meeting at the at least one attachment portion; wherein the first side portion and a second side portion, of each of the ones of the side elements, are each of a length less that a length of one of the base sides so as to allow nesting of disassembled ones of the side units within the storage volume of an assembled bin.

According to a further teaching of the present invention, at least one of the attachment portions includes a vertical post integrally formed with one of the side elements, the post having a substantially hollow vertical channel and a lateral opening into the channel, the at least one of the attachment portions also having a projection integrally formed with another of the side elements, the projection being configured to project through the lateral opening into the vertical channel of the post, a locking element being configured so as to be slidingly deployable within the vertical channel of the post between an unlocked position in which the projection can be inserted and removed from the lateral opening and a locked position in which the locking element engages the projection so as to lock the projection within the channel, thereby locking together the adjacent ones of the side elements.

According to a further teaching of the present invention, at least one of the attachment portion configured for engagable locking is implemented as four attachment portions configured for engagable locking deployable to lock together adjacent ones of the sides at each of the attachment portions.

According to a further teaching of the present invention, the base, the side elements and the locking elements are all formed from polymer materials.

According to the teachings of the present invention there is further provided, a locking configuration for releasably securing together edges of at least part of two adjacent side elements of a knock-down shipping bin, the locking configuration comprising: a hollow vertical post integrally formed with a first of the adjacent side elements, the post having a vertical hollow channel and a lateral opening into the channel; a projection integrally formed with another of the adjacent side elements, the projection being configured to project through the lateral opening into the vertical channel of the post; and a locking element configured so as to be slidingly deployable within the vertical channel of the post between an unlocked position in which the projection can be inserted and removed from the lateral opening and a locked position in which the locking element engages the projection so as to lock the projection within the channel, thereby locking together the adjacent side elements.

According to a further teaching of the present invention, the locking element includes a resilient tab, and wherein the post includes a first locating aperture positioned such that, when the locking element is in the unlocked position, the resilient tab engages the first locating aperture so as to retain the locking element in the unlocked position and within the channel so as not to become misplaced.

According to a further teaching of the present invention, the locking element includes a resilient tab, and wherein the post includes a second locating aperture positioned such that, when the locking element is in the locked position, the resilient tab engages the second locating aperture so as to retain the locking element in the locked position.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
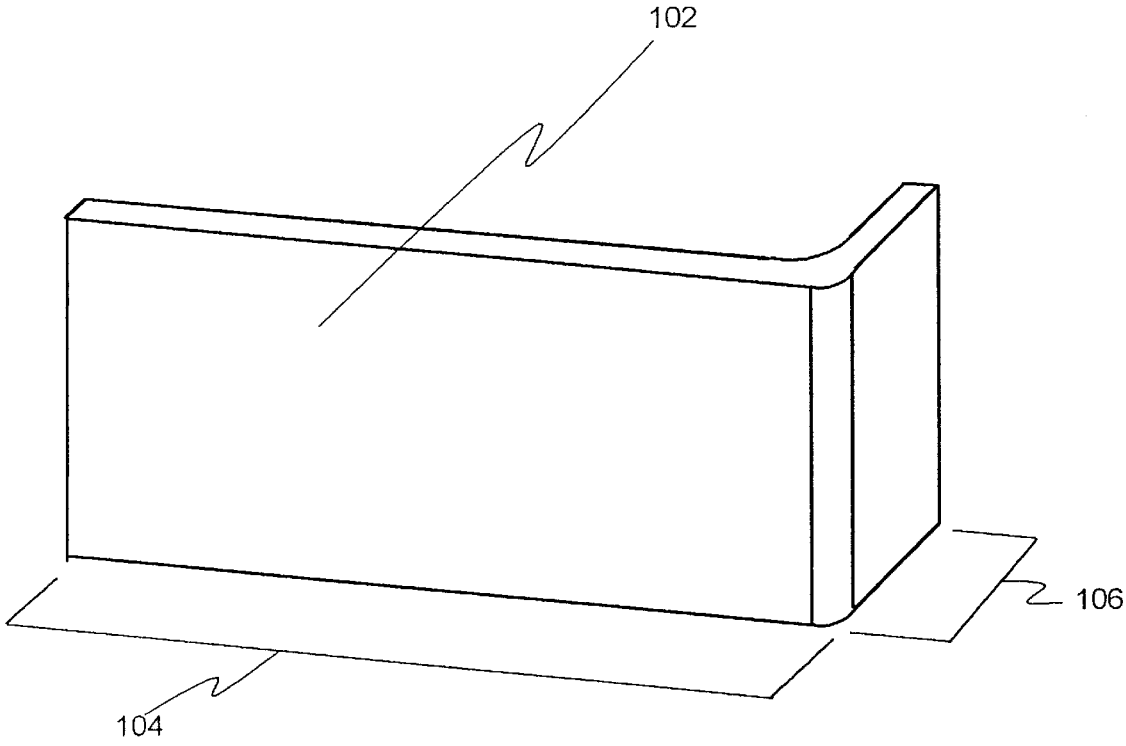
FIG. 1 is a schematic perspective view of a side element according to the teachings of the present invention.

The present invention is a square knock-down bin with "L" shaped side elements.

The principles and operation of square knock down bin with "L" shaped side elements according to the present invention may be better understood with reference to the drawings and the accompanying description.

Referring now to the drawings, FIGS. 1–5 schematically show major components of a bin according to the teachings of the present invention, to demonstrate the principles of the present invention.

Figure 2:
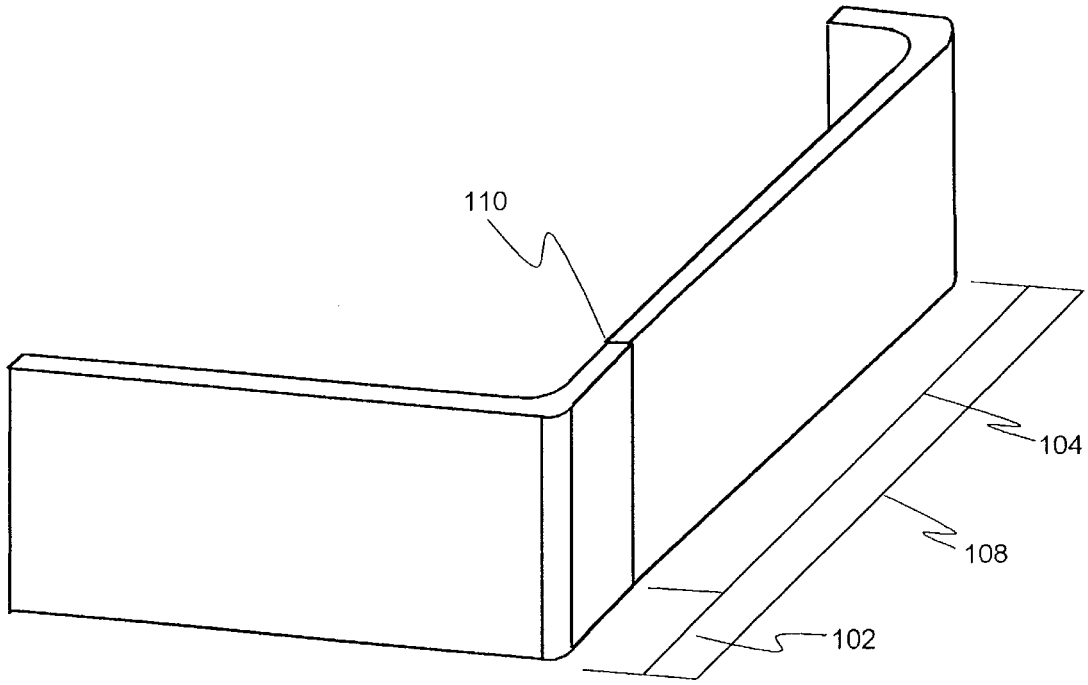
FIG. 2 is a schematic perspective view of two of the side elements of FIG. 1 aligned according to the teachings of the present invention.

FIG. 1 shows a side element 102 with a first dimension 104 and a second dimension 106. The "L" shaped configuration allows the side element to be deployed on two adjacent sides of a corresponding base. When two side elements are deployed adjacent to each other, the combined lengths 102 and 104 of the adjacent portions to the two side elements are equal to the length 108 of one of the sides of the base, as seen in FIG. 2. The two adjacent side elements are locked together along the abutment joint 110. The lower edge of each side element is further configured so as to detachably engage the base along at least one dimension of the lower edge of the side element.

Figure 3:
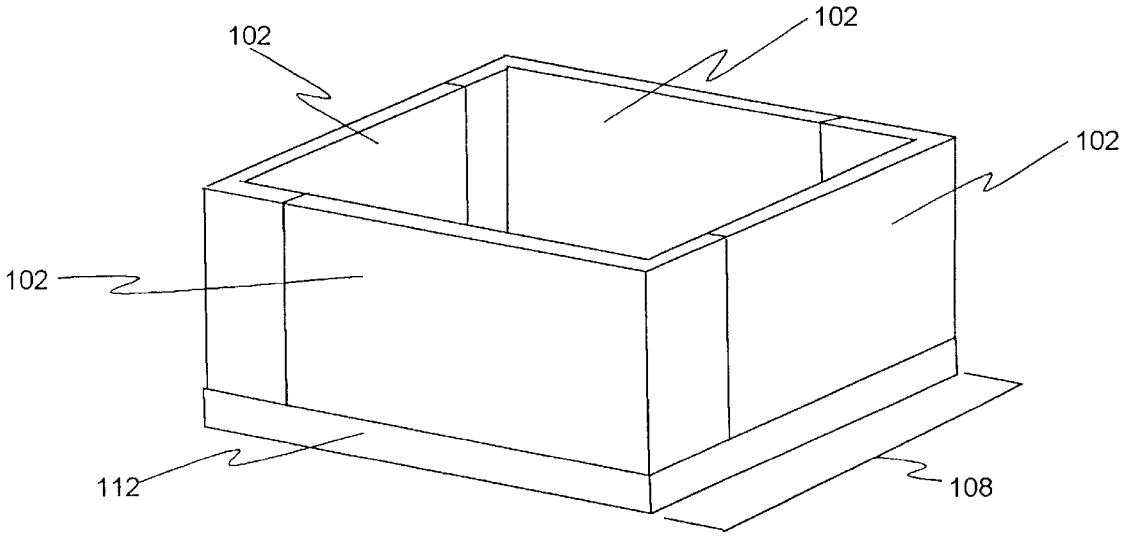
FIG. 3 is a schematic perspective view of a bin according to the teachings of the present invention.

The schematic of FIG. 3 shows all four side elements 102 deployed on a substantially square base 112 to form a complete bin, which has substantially equal side lengths 108.

Figure 4:
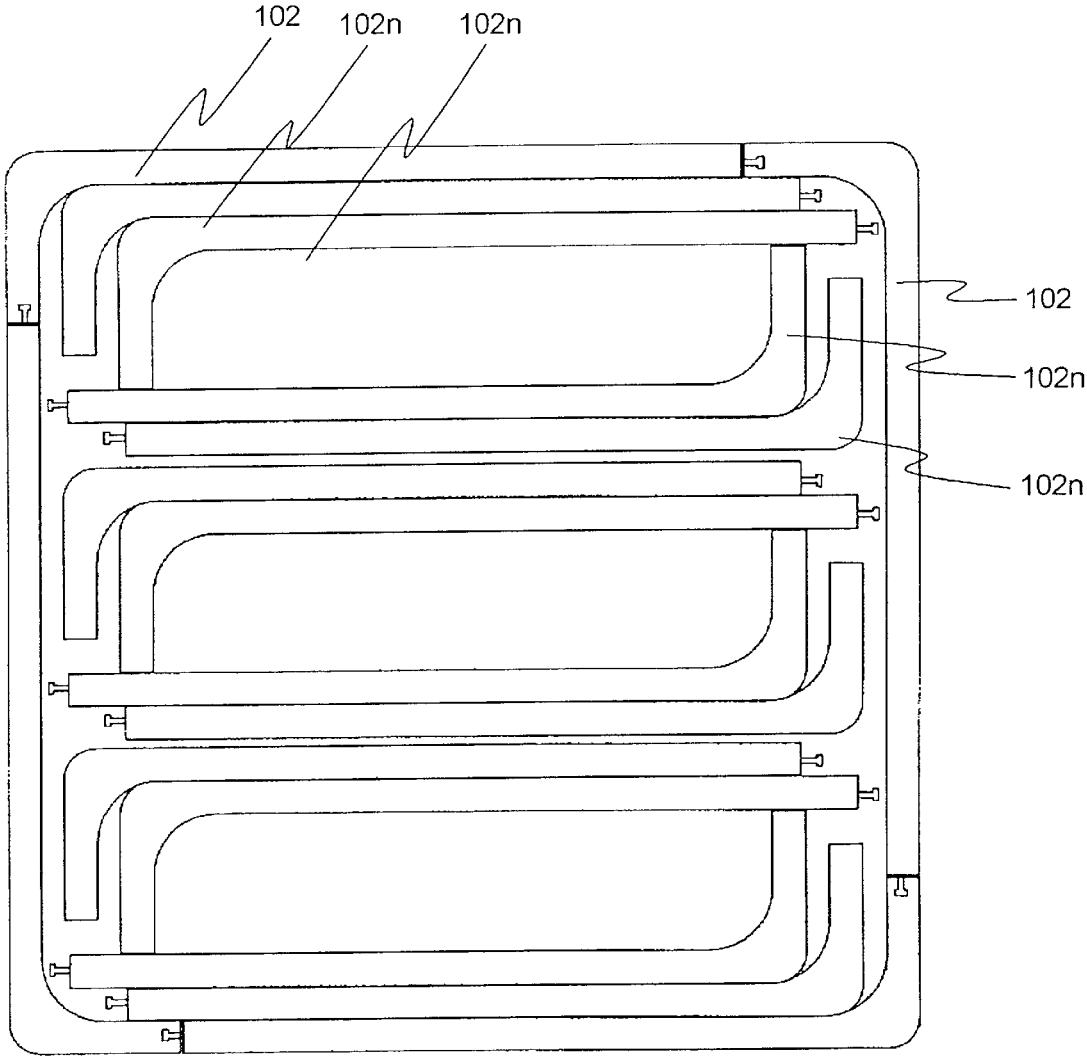
FIG. 4 is a schematic top view of side elements of a plurality of bins nested inside an assembled bin according to the teachings of the present invention.

FIG. 4 shows a non-limiting example of a nesting arrangement whereby the disassembled side elements 102*n* of, shown here, three bins are nested inside an assembled bin, illustrated here by side elements 102. Here, a set is formed by of two sides from a bin that are nestled against each other facing another two sides that are also nestled against each other with the "L" shape facing in the opposite direction. This pattern is repeated for up to three sets of sides.

Before addressing the features of the invention in more detail, it should be noted that base 112 is described as "substantially square" to the extent that the resulting bin assumes an overall square form. It should be noted, however, that the external outline of the edges of the base need not closely resemble a square. Variations from a regular square shape are frequently caused by the form of reinforcing ribs and other features specific to various intended applications.

Turning now to preferred implementations, the features of the present invention illustrated herein show a bin which may be disassembled into separate elements. Accordingly, side elements 102 preferably feature a lower edge configured for detachable engagement with base 112. In one preferred implementation, the form of engagement between side elements 102 and base 112 is configured such that the side elements are engagable with, and disengagable from, base 112 while being held in an inclined position relative to the base, but become locked in engagement with base 112 when raised to an upright position. An example of such an engagement configuration will now be described with particular reference to FIGS. 5–9.

Figure 5:
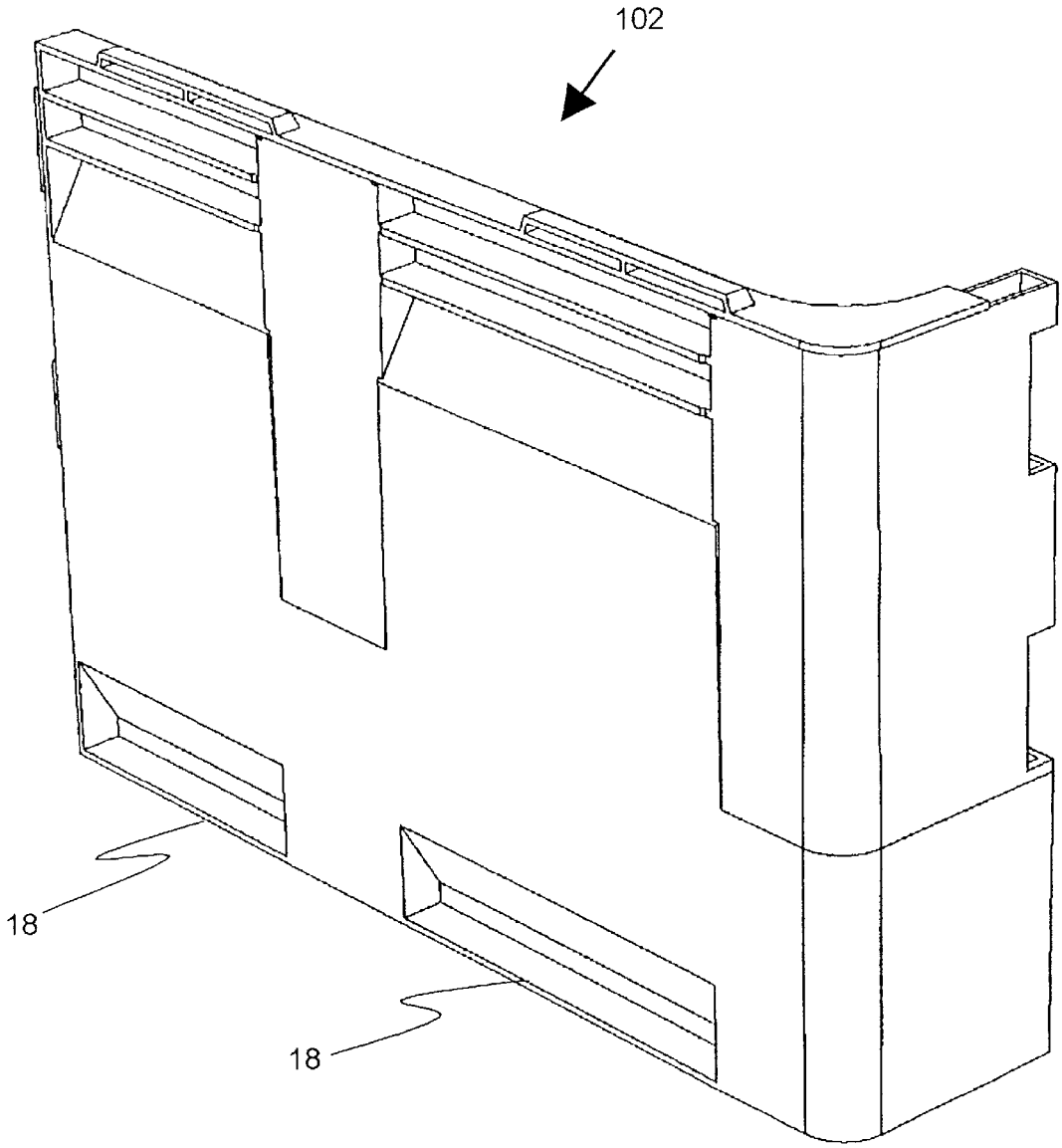
FIG. 5 is a perspective view of a preferred embodiment of a side element constructed and operative according to the teachings of the present invention.

FIG. 5 shows a side element 102 with engagement surfaces 18 for engagement with base mounted hook brackets.

Figure 6:
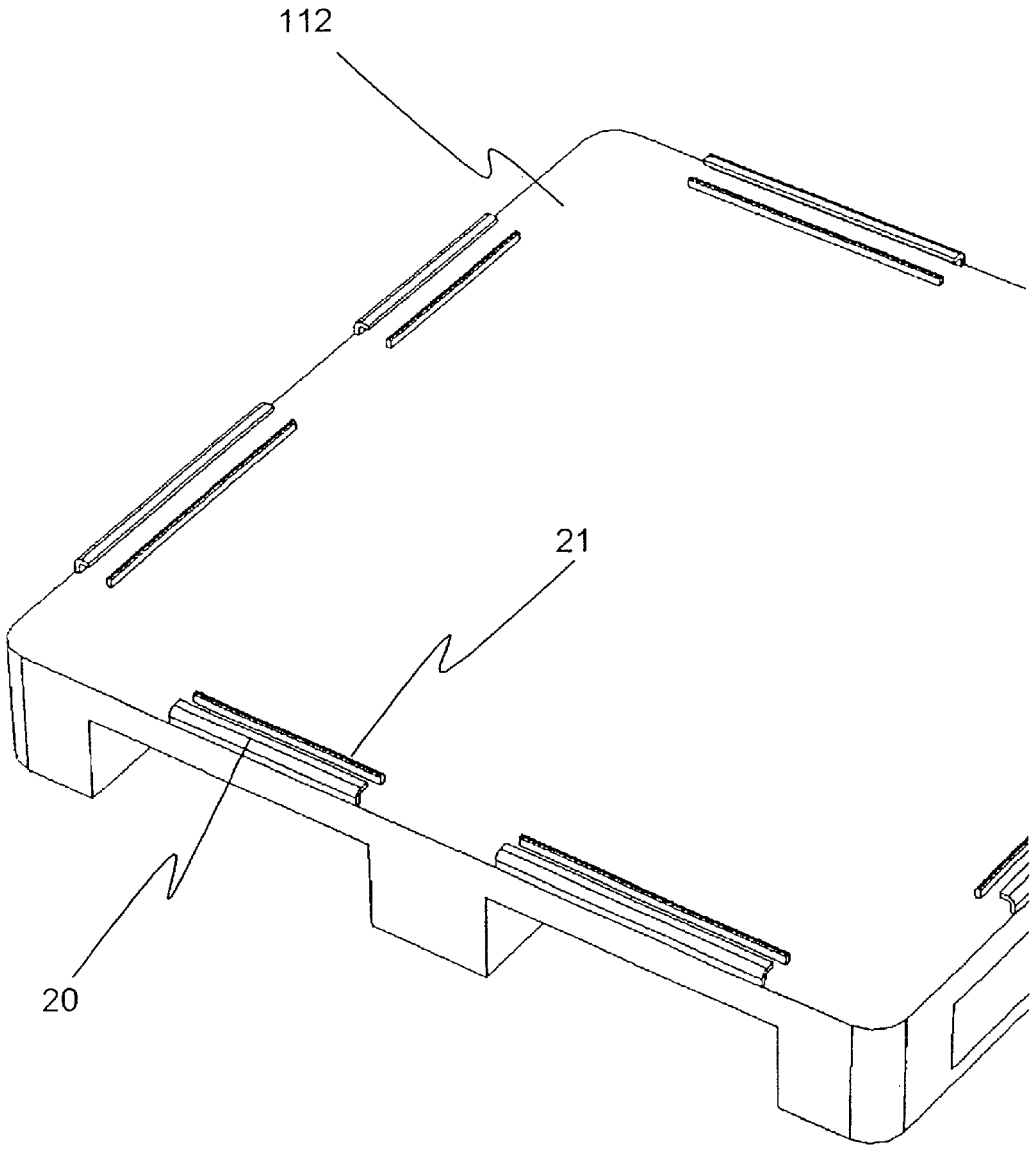
FIG. 6 is a perspective view of a portion of a preferred embodiment of a base constructed and operative according to the teachings of the present invention.

As seen in FIG. 6, base 112 features a row of hook brackets 20 spaced along each side. Inwardly spaced on base 112 from brackets 20 is a row of abutment ridges 21.

Figure 7:
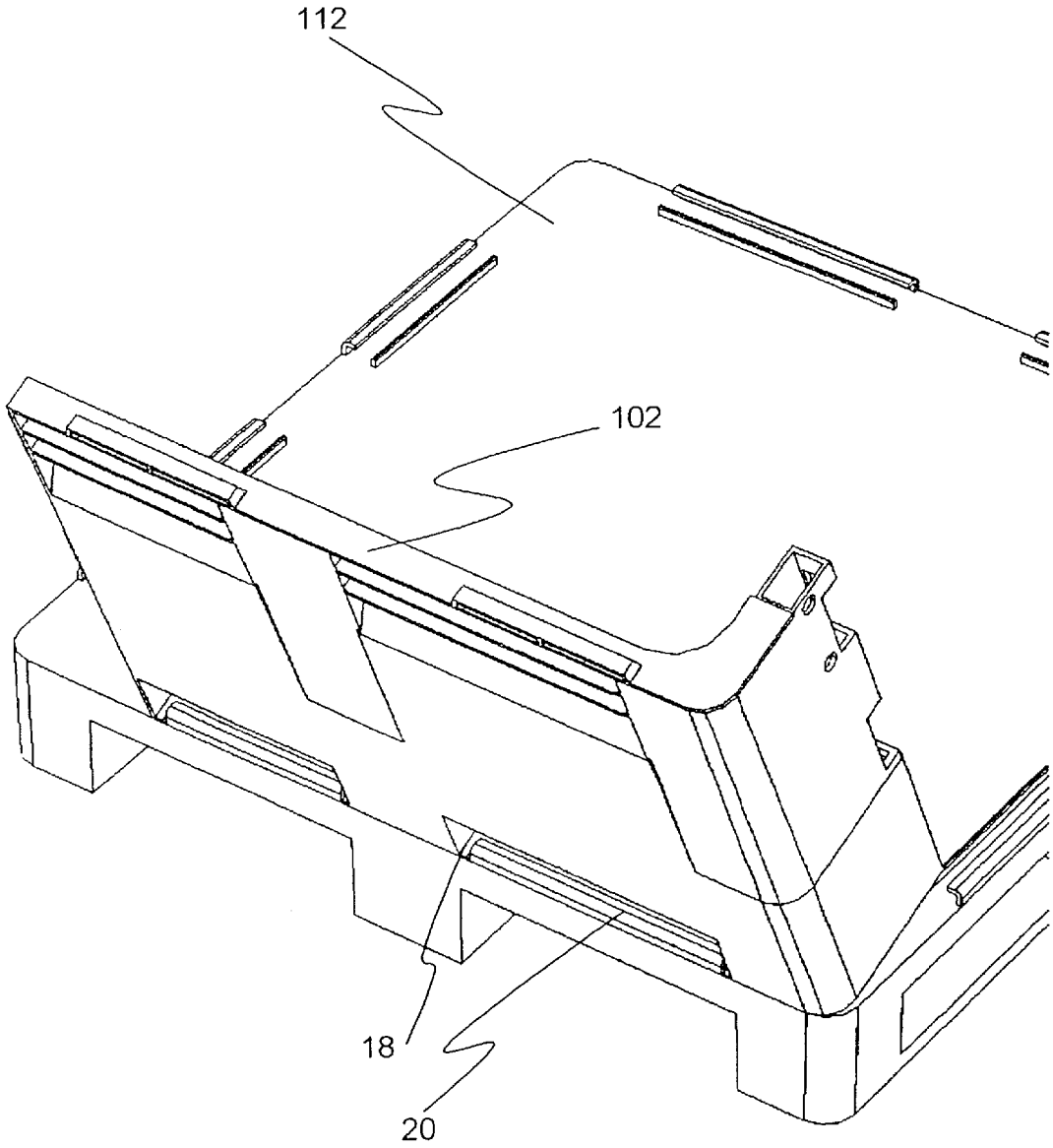
FIG. 7 is a perspective detail showing one of the side elements during attachment to the base.
Figure 8:
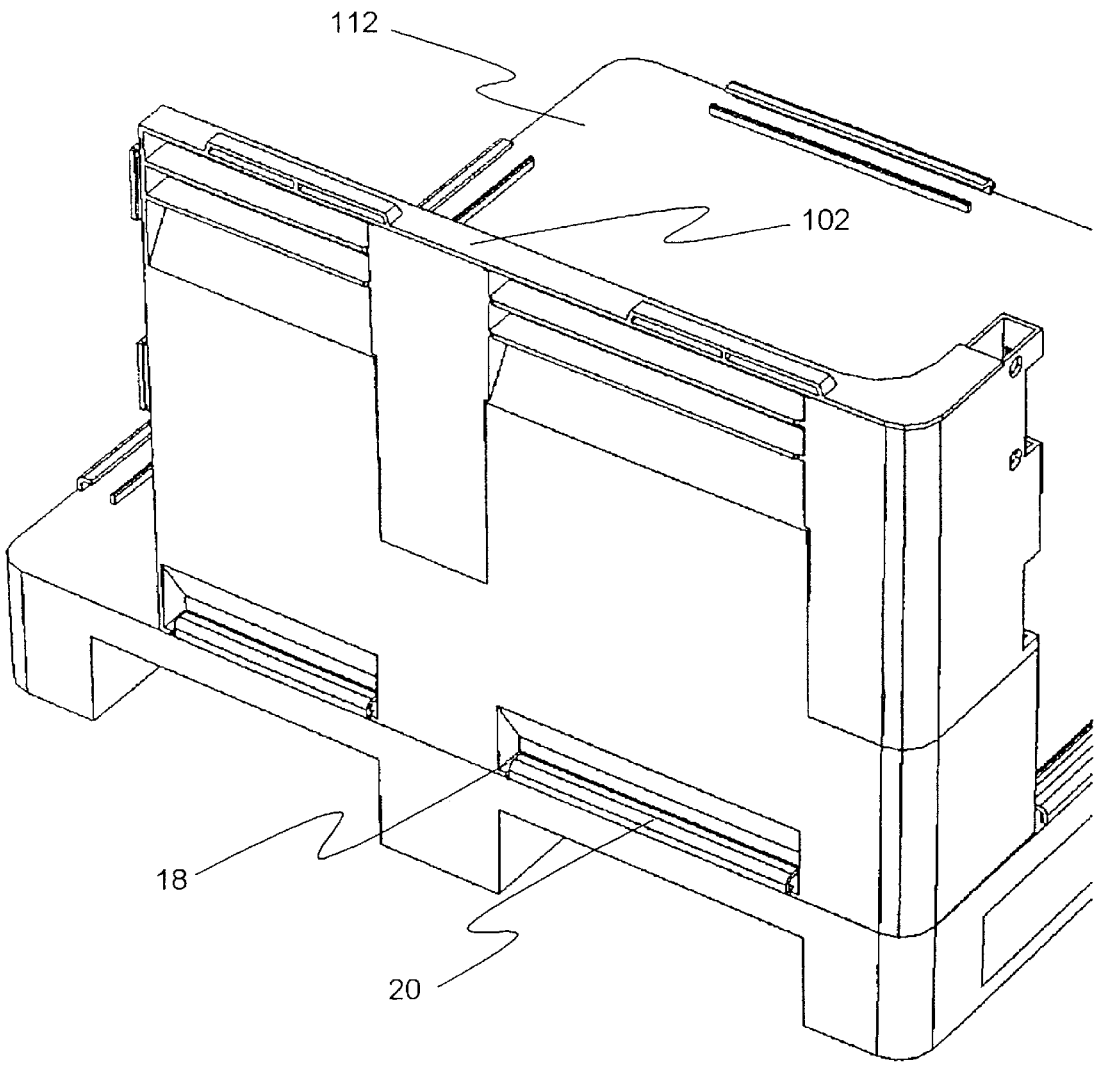
FIG. 8 is a perspective detail similar to FIG. 7 after attachment of the side element to the base.
Figure 9:
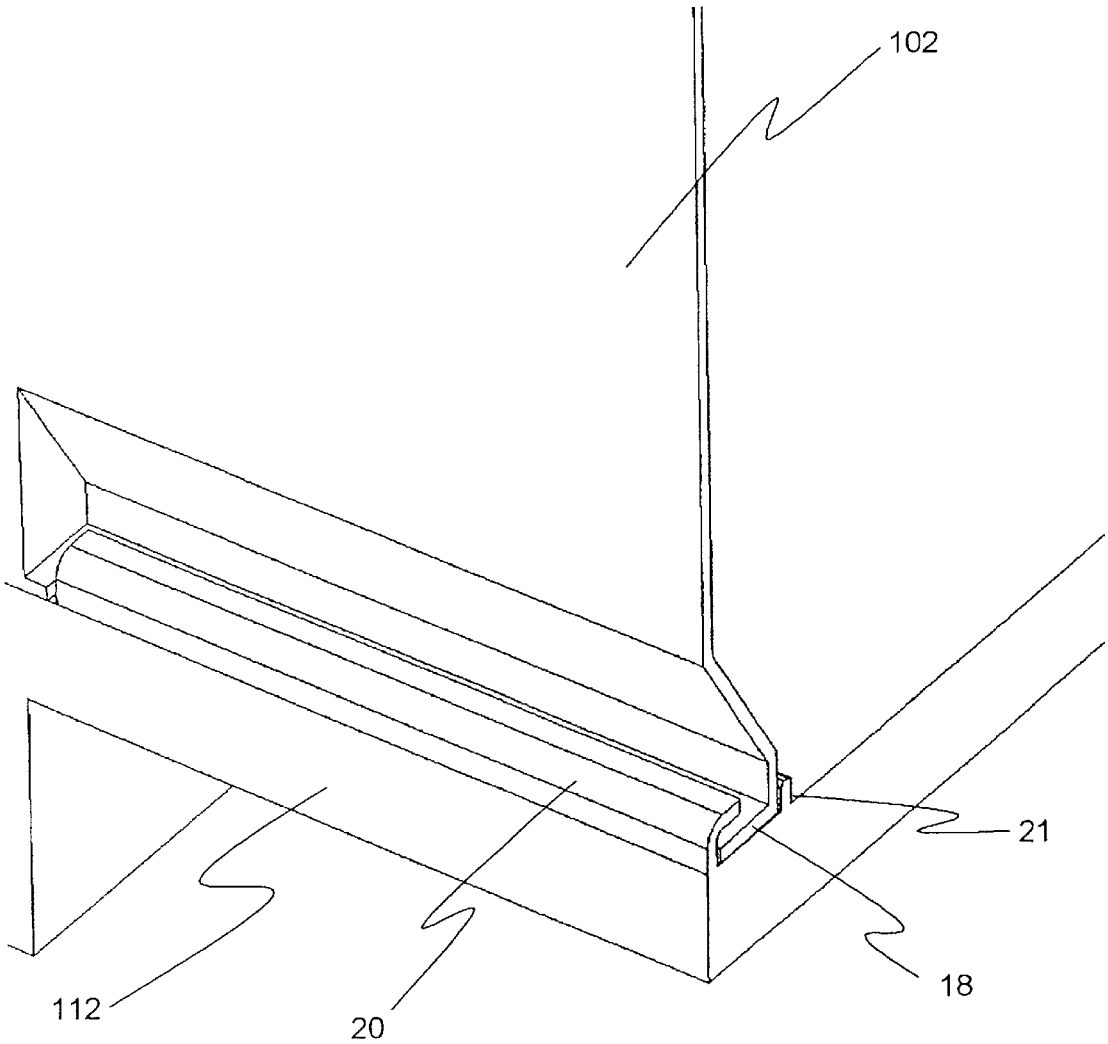
FIG. 9 is a partially cut-away of a portion of FIG. 8.

Attachment of the side elements is then achieved by positioning each side element in an outwardly-sloping position, as shown in FIG. 7, with engagement surfaces 18 aligned with brackets 20 and erecting the side element to the position shown in FIGS. 8 and 9 so that engagement surfaces 18 become locked under brackets 20. Abutment ridges 21 abut the inner face of the side element, thereby preventing the side element from slipping away from brackets 20 and limiting longitudinal movement of the side elements along the line of contact with base 112.

It will be appreciated that the form of engagement described provides effective and rigid locking against movement of the sides relative to the base in all directions except for outward rotation back to the position of FIG. 7. This motion is then prevented by the locking together of the sides, thereby rendering the bin a strong and rigid unitary structure.

It should be noted that the configuration described thus far for engagement of the sides with the base is one example of a preferred implementation but may be substituted by other structures.

Figure 11:
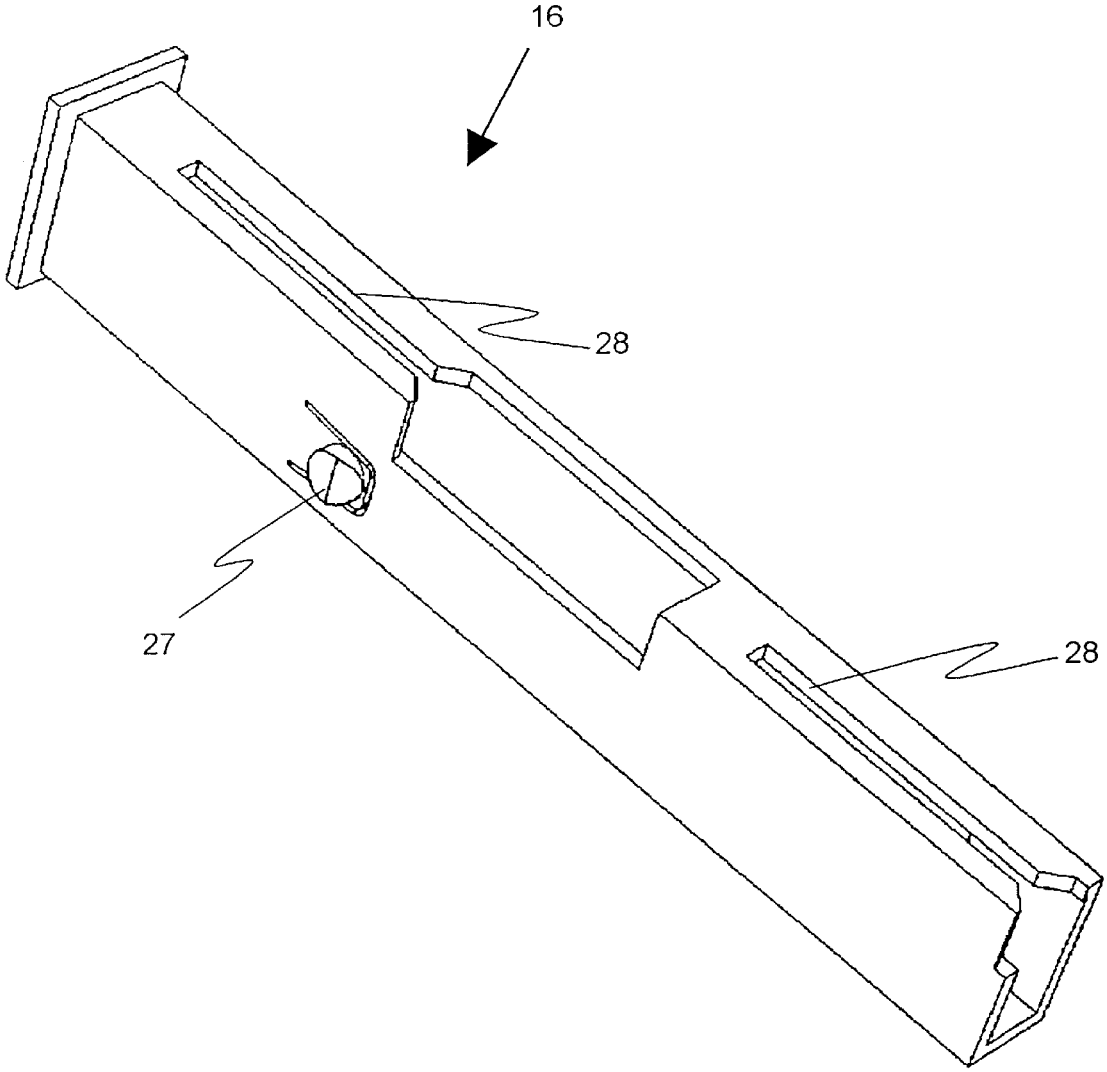
FIG. 11 is a perspective view of a locking element deployable in the side element of FIG. 5.
Figure 13:
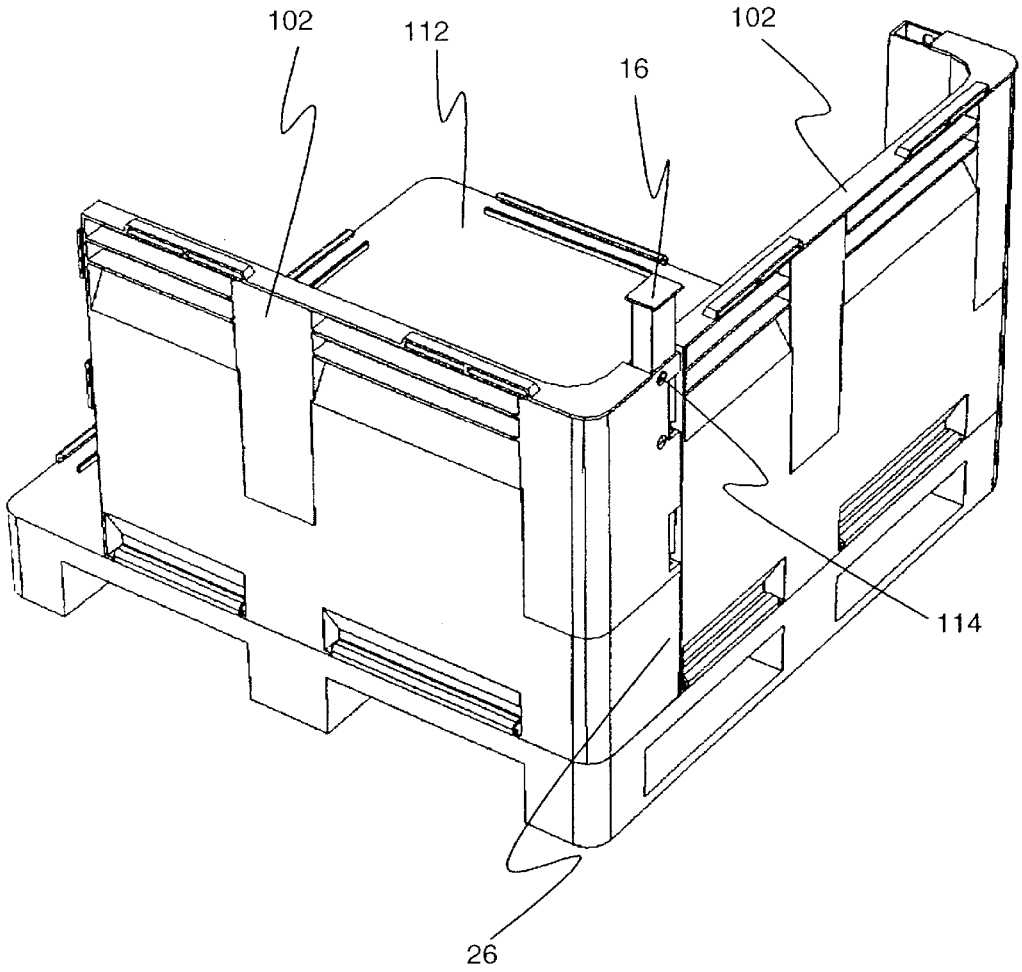
Figure 14:
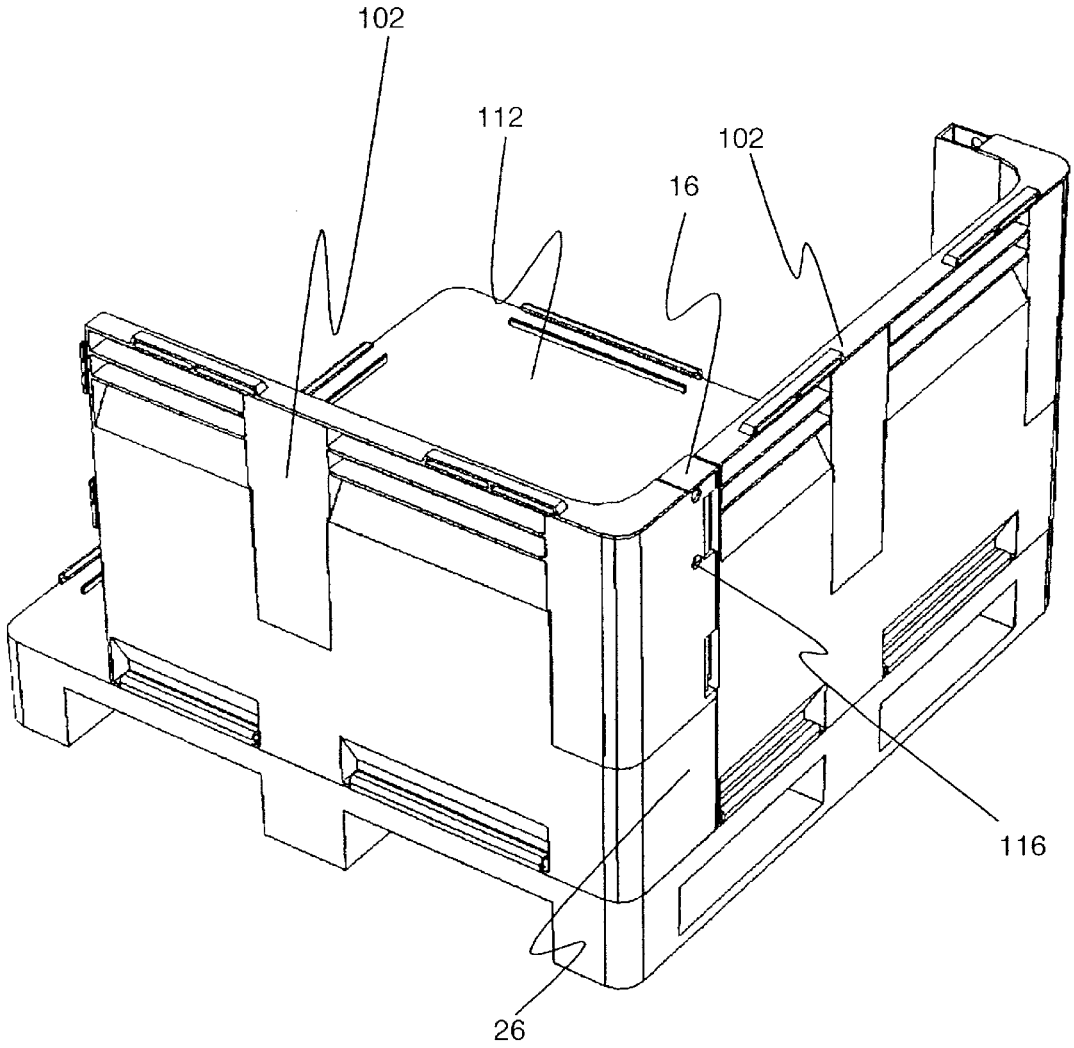

Turning now to locking element 16, a preferred implementation of this is shown in FIG. 11. This non-limiting example of a locking element 16 features a number of slots 28 corresponding to the number of lateral openings 24 in vertical post 26. For large bins, this number is preferably at least two. For lightweight applications or for smaller bins (such as for domestic storage and the like), one point of engagement may be used. There is also a resilient tab 27 that holds the locking element 16 in place in either the locked in conjunction with hole 114 (as shown in FIG. 13), or the unlocked position in conjunction with hole 116 (as shown in FIG. 14). This tab further acts to retain the locking element in its channel so as not to become separated from the side element in which it is deployed and possibly lost. It should be noted that this configuration in intended as a non-limiting example, and any mechanism that retains any configuration of the locking element in either a locked or unlocked position, or in the channel is within the intentions of the present invention.

Figure 10:
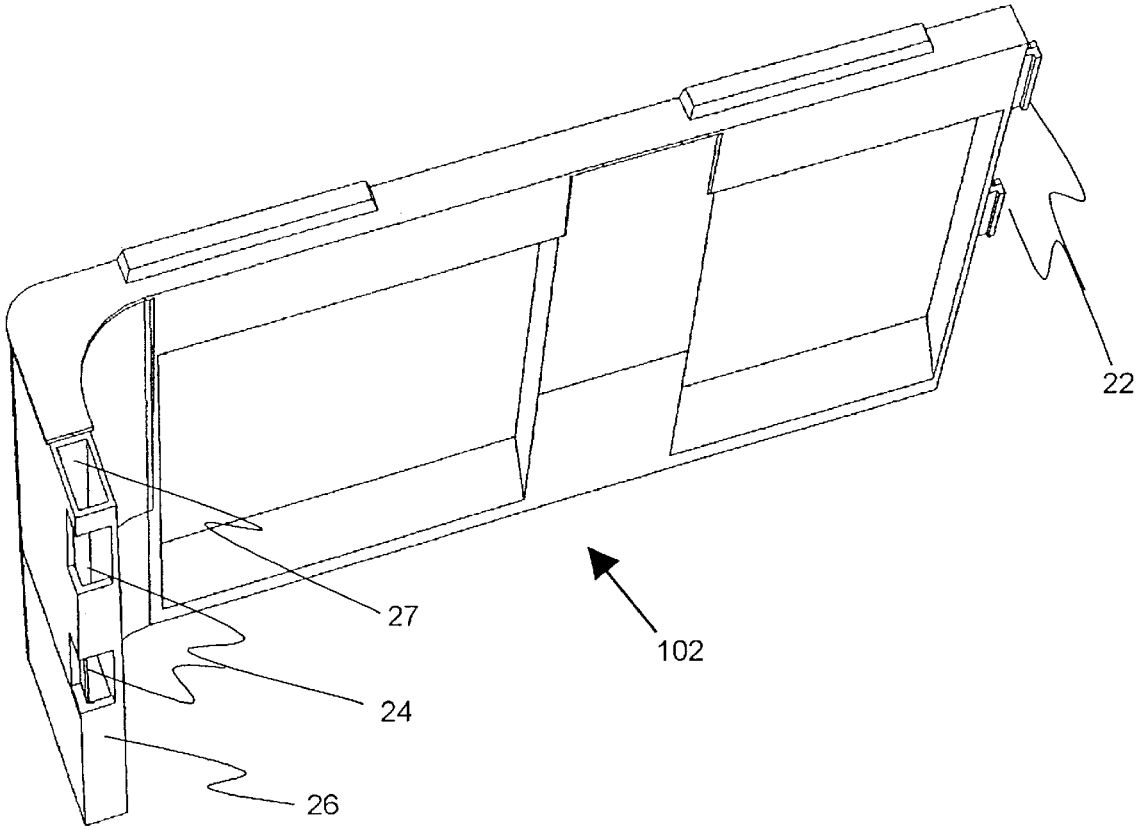
FIG. 10 is a perspective view of a preferred embodiment of a side element constructed and operative according to the teachings of the present invention.
Figure 12:
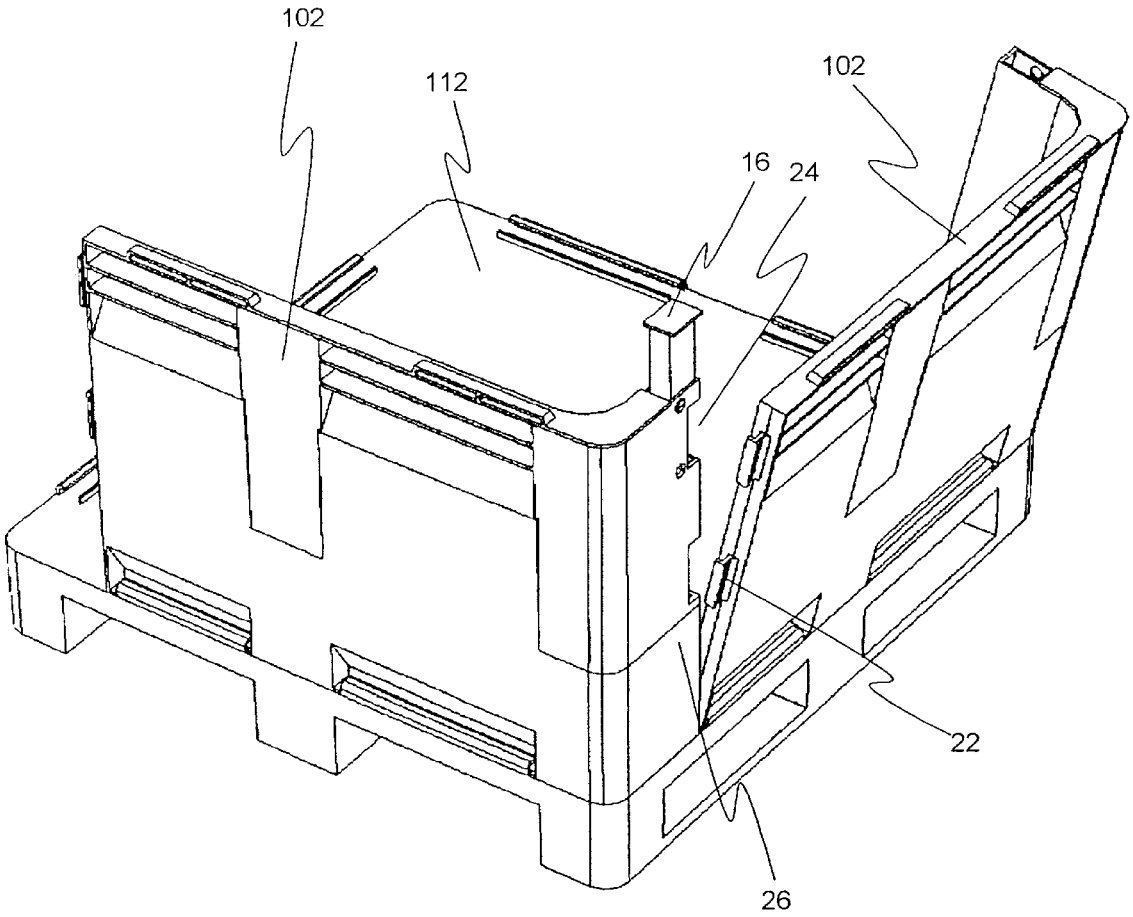
FIGS. 12–14 are a series of perspective views showing the positioning of adjacent side elements and sliding of the locking element from an unlocked position to a locked position in which is locks together the first and second side elements of the bin.

Generally speaking, the knock-down bin includes a substantially square base 112 and side elements 102 associated with base 112. Adjacent side elements 102 meet to define four vertical attachment portions. At least one of these attachment portions, and preferably all four, are provided with a locking element 16 deployable to lock together adjacent side elements. More specifically, as seen in FIG. 10, each of the side elements includes a vertical post 26 integrally formed with one of the ends of the side element. Post 26 has a vertical channel 27 into which opens at least one lateral opening 24. It should be noted that the vertical channel may be configured as completely circumscribed by the post, as illustrated here by non-limiting example. Among other non-limiting configurations, the post may be open along one side of the channel, thereby configuring the channel as a "U" shaped channel. That is to say, as illustrated here, the vertical channel is a hollow vertical channel within the vertical post. The term "hollow" as used herein, however, need not refer to a totally circumscribed empty volume, but is intended to include an empty volume that is partially circumscribed. A projection 22, integrally formed with the other end of the side element, is configured to project through lateral opening 24 into vertical channel 27 of the adjacent side element. Locking element 16 is slidingly deployable within vertical channel 27 between an unlocked position (FIGS. 12 and 13) in which projection 22 can be inserted and removed from lateral opening 24 and a locked position (FIG. 14) in which locking element 16 engages projection 22 so as to lock it within channel 27, thereby locking together the adjacent side elements 102. It should be noted that the vertical post and the projections may be associated with either end of the side element. Alternatively, the attachment apparatus may be configured as a separate element. A further alternative that should be noted is that of side elements that are configured for interlocking attachment and are deployed on the base in a specific order. That is, a first side element is attached to the base, a second then attaches to the base and the first side element, a third side element then attaches to the base and the second side element, and a forth side element attaches to the base and is attached to the first side element by use of a locking element such as the sliding locking element described above.

It will be readily apparent that a square bin employing the "L" shaped side elements of the present invention provides a convenient and effective solution to various shortcomings of the prior art with regard to the nestability of the sides of several disassembled bins within an assembled bin.

It will be appreciated that the above descriptions are intended only to serve as examples, and that many other embodiments are possible within the spirit and the scope of the present invention.

What is claimed is:

1. A square knock-down shipping bin comprising:

(a) a substantially square base having four substantially equal length base sides;

(b) four side elements having a first side portion and a second side portion that are perpendicular to each other meeting at a corner of the bin so as to define portions of two adjacent sides of the bin, said side elements being deployed so that said second side portion of one of said side elements is deployed along the same base side as, and substantially meets, said first side portion of an adjacent one of said side elements, thereby defining four vertical attachment portions configured for engagable locking of said first side portion and said second side portion meeting at said at least one attachment portion;

wherein said first side portion and a second side portion, of each of said ones of said side elements, are each of a length less that a length of one of said base sides so as to allow nesting of disassembled ones of said side units within the storage volume of an assembled bin.

2. The bin of claim 1, wherein said at least one of said attachment portions includes a vertical post integrally formed with one of said side elements, said post having a substantially hollow vertical channel and a lateral opening into said channel, said at least one of said attachment portions also having a projection integrally formed with another of said side elements, said projection being configured to project through said lateral opening into said vertical channel of said post, a locking element being configured so as to be slidingly deployable within said vertical channel of said post between an unlocked position in which said projection can be inserted and removed from said lateral opening and a locked position in which said locking element engages said projection so as to lock said projection within said channel, thereby locking together said adjacent ones of said side elements.

3. The bin of claim 2, wherein said at least one of said attachment portion configured for engagable locking is implemented as four attachment portions configured for engagable locking deployable to lock together adjacent ones of said sides at each of said attachment portions.

4. The bin of claim 1, wherein said base, said side elements and said locking elements are all formed from polymer materials.

5. The bin of claim 1, further comprising a locking configuration for releasably securing together edges of at least part of two adjacent said side elements of the knock-down shipping bin, said locking configuration comprising:

(a) a hollow vertical post integrally formed with a first of said adjacent side elements, said post having a vertical hollow channel and a lateral opening into said channel;

(b) a projection integrally formed with another of said adjacent side elements, said projection being configured to project through said lateral opening into said vertical channel of said post; and (c) a locking element configured so as to be slidingly deployable within said vertical channel of said post between an unlocked position in which said projection can be inserted and removed from said lateral opening and a locked position in which said locking element engages said projection so as to lock said projection within said channel, thereby locking together the adjacent side elements.

6. The bin of claim 5, wherein said locking element includes a resilient tab, and wherein said post includes a first locating aperture positioned such that, when said locking element is in said unlocked position, said resilient tab engages said first locating aperture so as to retain said locking element in said unlocked position and within said channel so as not to become misplaced.

7. The bin of claim 6, wherein said locking element includes a resilient tab, and wherein said post includes a second locating aperture positioned such that, when said locking element is in said locked position, said resilient tab engages said second locating aperture so as to retain said locking element in said locked position.

* * * * *